United States Patent [19]

Koinuma et al.

[11] 4,071,804

[45] Jan. 31, 1978

[54] MAGNETRON DEVICE HAVING MAGNETIC MEANS FOR GENERATING A UNIFORM INTERACTION FIELD

[75] Inventors: Tokuju Koinuma, Kawasaki; Hideki Yamamiya, Yamato; Norio Tashiro, Yokohama, all of Japan

[73] Assignee: Tokyo Shibaura Electric Co., Ltd., Kawasaki, Japan

[21] Appl. No.: 772,142

[22] Filed: Feb. 25, 1977

Related U.S. Application Data

[63] Continuation of Ser. No. 654,532, Feb. 2, 1976.

[30] Foreign Application Priority Data

Jan. 31, 1975 Japan ..... 50-13227
Mar. 8, 1975 Japan ..... 50-28281

[51] Int. Cl.[2] ..... H01J 25/50

[52] U.S. Cl. ..... 315/39.71; 315/39.51; 315/5.35

[58] Field of Search ..... 315/39.51, 39.71, 5.35

[56] References Cited

U.S. PATENT DOCUMENTS

| | | | |
|---|---|---|---|
| 3,300,681 | 1/1967 | Bessarab | 315/39.71 |
| 3,392,308 | 7/1968 | Cook | 315/39.71 X |
| 3,454,824 | 7/1969 | Owaki et al. | 315/39.71 |
| 3,781,592 | 12/1973 | Harrold | 315/39.71 |
| 3,855,498 | 12/1974 | MacMaster et al. | 315/39.71 |
| 3,881,127 | 4/1975 | MacMaster et al. | 315/39.71 |
| 3,916,247 | 10/1975 | Koinuma et al. | 315/39.71 |

FOREIGN PATENT DOCUMENTS

| | | | |
|---|---|---|---|
| 222,417 | 3/1958 | Australia | 315/39.71 |

*Primary Examiner*—Saxfield Chatmon, Jr.
*Attorney, Agent, or Firm*—Oblon, Fisher, Spivak, McClelland & Maier

[57] ABSTRACT

A magnetron for oscillating ultrashort waves by uniformly applying a magnetic field to electrons, which comprises a cylindrical electrode assembly consisting of concentrically arranged cathode and anode electrodes; a magnetizing device formed of a pair of mutually facing permanent magnets prepared from rare earth so as to apply a magnetic field at right angles to electrons emitted from the cathode electrode to the anode electrode; and wherein the mutually facing magnetic pole surfaces of the paired permanent magnets are so depressed as to present a surface shaped in the form of a revolving ellipsis in order to apply a uniform magnetic field to electrons for control of their orbit, thereby producing from an outlet circuit oscillated electric waves which have resonated in the resonance cavity section of the anode electrode.

15 Claims, 17 Drawing Figures

MAGNETRON DEVICE HAVING MAGNETIC MEANS FOR GENERATING A UNIFORM INTERACTION FIELD

This is a continuation, of application Ser. No. 654,532 filed Feb. 2, 1976, now abandoned.

BACKGROUND OF THE INVENTION

This invention relates to a magnetron provided with magnetic field-applying means capable of equalizing the intensity of every portion of a magnetic field applied.

Generally, magnetron is a sort of diode designed to oscillate current introduced across concentric cylindrical cathode and anode electrodes by a magnetic field applied in the axial direction of said electrodes, and is provided with a magnetic field-applying device for applying a magnetic field at right angles to a stream of electrons running across the cathode and anode electrodes. The prior art magnetic field-applying device has a pair of mutually facing permanent magnets so arranged as to enclose an interaction space formed between the cathode and anode electrodes, from above and below, in order to apply a magnetic field at right angles to said interaction space, that is, in the axial direction of the cathode and anode electrodes. The prior art permanent magnets have the mutually facing magnetic pole surfaces made flat. Therefore, a magnetic field applied to the interaction space formed between the mutually facing permanent magnets is ununiformly distributed. Namely, the concentration of a magnetic flux is dense in the interaction space around the center of the mutually facing permanent magnets, but sparse in that portion of the interaction space which is disposed near the peripheral edge of the permanent magnets. Electrons emitted from the cathode electrode to the anode electrode fail to reach the anode electrode through a desired uniform orbit due to the irregular distribution of a magnetic field in the above-mentioned various interaction spaces.

Therefore, the prior art magnetron has the drawbacks that it has a low efficiency of oscillating electric waves and lacks an oscillating stability. If a magnetic field generated by permanent magnets has an ununiform distribution, it will be extremely objectionable particularly to a magnetron which is demanded to produce a high density of magnetic fluxes and a very strong magnetic force.

SUMMARY OF THE INVENTION

It is accordingly the object of this invention to provide a magnetron of great practical use which is provided with a magnetizing device enabling a magnetic field to be uniformly distributed in an interaction space formed between the cathode and anode electrodes.

According to this invention, the mutually facing magnetic pole surfaces of a pair of permanent magnets are so depressed as previously mentioned, as to present a surface shaped in the form of a revolving ellipse, decreasing magnetic resistance in the peripheral edge of the permanent magnets. Therefore, a magnetic field in the interaction space formed between the mutually facing permanent magnets is uniformly distributed in both central and peripheral edge portions of said permanent magnets. This uniform distribution of a magnetic field in the interaction space formed between the cathode and anode electrodes attains the stable and efficient oscillation of electric waves. This invention has further advantages that the permanent magnet used is formed of compact and light weight rare earth having a strong magnetic force, thereby enabling the resultant magnetron as a whole similarly to have a small size and light weight; the hollow cylindrical form of permanent magnets saves the required amount of magnetic material, thereby reducing the weight of permanent magnets and in consequence an entire magnetron; and further according to another aspect of the invention, a separate concave magnetic member is mounted on each of the mutually facing flat magnetic pole surfaces of a pair of permanent magnets, facilitating the fabrication of a magnetron.

DETAILED DESCRIPTION OF THE INVENTION

Figure 1:
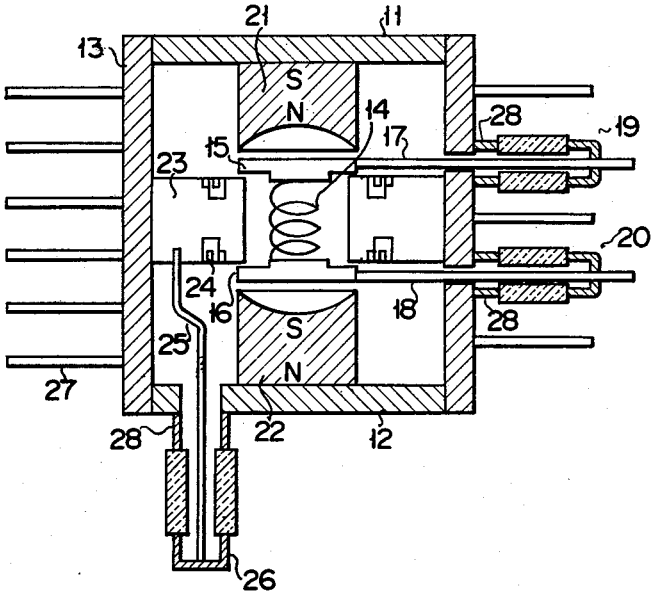
FIG. 1 is a fractional sectional view of a magnetron according to an embodiment of this invention.

FIG. 1 shows a directly heated vane-type magnetron according to an embodiment of this invention. As illustrated in FIG. 1, the magnetron of this invention comprises a hollow cylindrical anode 13 enclosed in relay iron plates 11, 12 and a coil-shaped cathode 14 which is axially disposed substantially in the center of said hollow cylindrical anode 13 and has both ends held on support members 17, 18 by means of the corresponding end hats 15, 16. The support members 17, 18 penetrate the wall of the anode 13 to be respectively connected to the corresponding terminals 19, 20 fitted to the outer surface of the anode 13.

The magnetizing device comprises a pair of round columnar permanent magnets 21, 22 fitted to the relay iron plates 11, 12 of the anode electrode 13 respectively so as to face each other in the axial direction of the anode electrode 13. These permanent magnets 21, 22 are each prepared from rare earth such as samarium which generates a strong magnetic force with a high flux density, and have the mutually facing magnetic pole surfaces so depressed as to present a surface shaped in the form of a revolving ellipsis. A plurality of vanes 23 are fitted to the inner wall of the anode 13 radially and at an equal circumferential distance in a manner to surround the cathode 14. The one of two metal straps 24 is secured to the top portions of alternate vanes 23 constituting one group and the other similarly to the top portions of the remaining vanes 23 constituting other group. Same structure is also provided with at the bottom of said vanes. Thus, these four metal straps 24 cooperate firmly to couple together all the vanes 23. The spaces defined between the restrictive adjacent vanes 23 constitute resonance cavities. The resonance cavities 30 are defined by a portion of the anode and the vanes 23. An output circuit has an antenna leadout section 25 drawn out from any of the resonance cavities to be used as a connection loop for connecting the magnetron to an external apparatus. Said antenna leadout section 25 penetrates the relay iron plate 12 to be connected to an antenna lobe 26 fitted to the outer surface of said relay iron plate 12, thereby emitting an output electric wave to the outside. Referential numeral 27 denotes radiator fins formed on the inner periphery of the cylindrical anode 13. The fins 27 radiate the heat built up in the magnetizing device to the outside.

Figure 2:
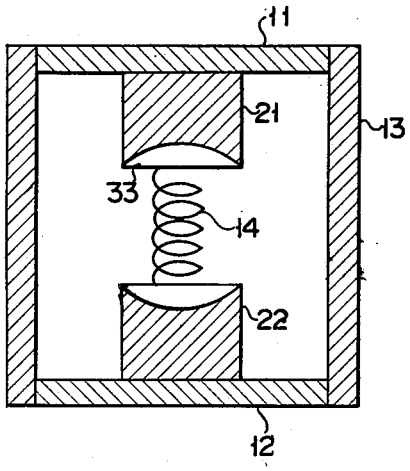
FIG. 2 is a schematic sectional view illustrating the main part of the magnetron of FIG. 1.

To keep an interaction space provided between the cathode electrode 13 and anode electrode 14 in an evacuated state, the terminals 19, 20 and antenna lobe 26 are each sealed airtight in, for example, a supporting member 28 provided with an insulator. FIG. 2 sets forth in detail a magnetizing device used with the magnetron of FIG. 1. Rare earth magnets 21, 22 prepared from, for example, samarium to be used as a magnetizing device are fitted to the inner walls of the relay iron plates 11, 12 of the cylindrical anode electrode 13 so as to face the upper and lower ends of the cathode 14 respectively vertically, or in the axial direction of the cylindrical anode electrode 13. Each cylindrical samarium magnet has a diameter of, for example, 20 mm and a height of, for example, 7 mm. The mutually facing surfaces of the paired samarium magnets 21, 22 are formed into concave shapes having the same curvature radius. In this case, the center of the curvature radius is on the central line of the magnetic pole. The curvature center falling on the central line of the magnetic pole of the samarium magnet 21 and that of the counterpart samarium magnet 22 may be in alignment or out of alignment. The shortest distance between the mutually facing magnetic pole surfaces of the samarium magnets 21, 22 measures about 14 to 18 mm or 16 mm on the average. The concave portion 33 (FIG. 2) has a maximum depth of about 2 mm. Where the curvature radius is made unduly smaller than the radius of said interaction space, a magnetic flux can not be uniformly distributed in the interaction space. Therefore, the concave portion formed in the magnetic pole surface of each samarium magnet is chosen to have a similar or larger diameter than the diameter of the electron-actuating space defined by the vanes 23. Thus, the interaction space is defined to have a smaller diameter, for example, 10.5 mm than the 20 mm diameter of the samarium magnet 21, 22. The diameter of the cathode 14 is set at, for example, 5.3 mm. Accordingly, a fully uniform magnetic field is applied to the interaction space by the samarium magnets 21, 22. The depressed form of the rare earth magnet 21 or 22 used with the magnetizing device varies with, for example, the intensity of the force of said rare earth magnet, its size, the area of its magnetic pole surface and the space at which said rare earth magnet is set apart from the counterpart rare magnet.

Now let is be assumed that the terminals 19, 20 of the magnetizing device are impressed with prescribed D.C. voltage by a power source (not shown). Then the concentrically disposed cathode electrode 14 is heated to emit electrons. These emitted electrons are directed to the cylindrical anode electrode 13 already impressed with high positive voltage. In this case, the orbit of said electrons is diverted by an electric field created by the paired rare earth magnets 21, 22 and, which revolving about the axis of the magnetizing device, are brought into resonance cavities formed between the respective adjacent vanes 23. When supplied with electrons, the magnetron oscillates electric waves with a larger amount of energy due to the presence of a high frequency electric field in the intervening spaces between the respective adjacent vanes 23. The oscillation output is led out to the antenna lobe 26 through the antenna leadout section 25 and then to, for example, a wave guide (not shown).

Figure 3:
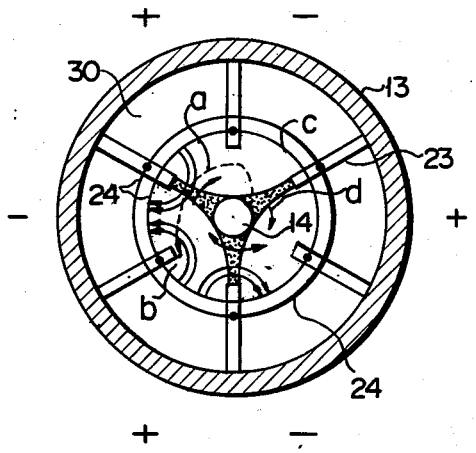
FIG. 3 is a sectional view of a magnetron as taken at right angles to its axial direction, showing its operating principle.

FIG. 3 sets forth the main part of the magnetron of FIG. 1 by way of diagrammatically showing the oscillation process. Electrons emitted from the cathode 14 undergo the effect of a magnetic field formed along the axis of the cathode 14 and revolve about said axis. It is known that with voltage across the cathode 14 and anode 13 taken to be constant, the radius of the above-mentioned revolution curvature tends to be progressively decreased as the intensity of a magnetic field created along the axis of the cathode 14 is elevated. Where electrons proceed through a magnetic field having a uniform intensity, then the electrons indicate substantially the same revolution curvature at any point of said magnetic field, if the cathode-anode voltage is not taken into account. Where, however, said cathode-anode voltage is used as a factor, then the electrons travel along a revolutionary orbit indicated by the solid line arrows *a*.

On the other hand, a resonance cavity 30 formed between the respective adjacent vanes 23 always contains extremely weak microwaves, even where the magnetron does not commence the oscillation. As the result, a high frequency electric field indicated by the arrows *b* of FIG. 3 is created between the respective adjacent vanes 23. The arrow *b* direction of said high frequency electric field is reversed per cycle of the oscillation. Under a normal condition, said high frequency electric field is oscillated in the opposite directions, namely, with a phase difference of 180° (radian) between the respective adjacent vanes 23. This condition shall be hereinafter called "$\pi$ mode". This oscillation does not transmit a high frequency energy represented by the so-called standing wave from one intervane space to another, but causes said standing wave as a whole seemingly to be shifted in the direction in which electrons revolve about the axis of the cathode 14. This phenomenon is similar to the fact that a wood block on waves merely goes up and down and never moves forward or backward though the waves appear as if propagating.

When coincidence takes place between the shifting speed (phase velocity) of the standing wave and the speed at which electrons emitted from the cathode 14 revolve about its axis, then the magnetron commences the oscillation Revolving electrons whose orbit has been controlled, as previously mentioned, by a uniform magnetic field are collected in the decelerated portion of the high frequency electric field (indicated by + sign in FIG. 3) in which electrons revolve opposite to the arrow direction of said electric field, presenting a spoke-like agglomeration of electrons as illustrated by *c* of FIG. 3. When brought into the decelerated portion of the high frequency electric field, the electrons of said group *c* revolve in the direction of a solid line arrow *d*, while giving off their energy to said electric field and fall to the anode side in a deenergized stage. Upon supply of electron energy to the high frequency magnetic waves created between the respective adjacent vanes 23, electric waves are oscillated with a larger amount of energy.

Since a strong, uniformly distributed magnetic field is applied by the magnetizing device to an interaction space, a magnetic force acts on the electrons at a constant rate throughout the magnetic field to reduce the revolution curvature of electrons, enabling a larger amount of energy to be supplied to the high frequency electric field produced between the respective adjacent vanes 23, and attaining a more efficient and stable oscillation than in the case where a magnetic field is ununiformly distributed.

Further advantages of this invention are that a permanent magnet used with the magnetizing device is formed of rare earth having a strong magnetic force, for example, samarium and has a weight as light as 1/10 to 1/20 of the weight of the prior art permanent magnet made of, example, strontium ferrite, and is also made compact, enabling a magnetron using such rare earth permanent magnet similarly to have a small size and light weight.

Figure 4:
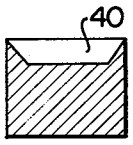
FIGS. 4 to 6 are axial sectional views of permanent magnets used with magnetizing devices according to other embodiments of the invention.
Figure 5:
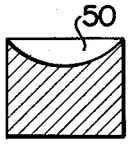
Figure 6:
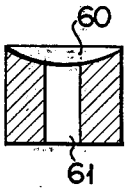

FIGS. 4, 5 and 6 set forth one of paired permanent magnets constituting each of the magnetizing devices of magnetrons according to other embodiments of this invention. As shown in FIG. 4, the magnetic pole surface of one type of permanent magnet may have a depression 40 whose surface presents the form of a trapezoid or a frust conical. As illustrated in FIG. 5, the magnetic pole surface of another type of permanent magnet may have a depression 50 whose cross section is shaped like a segment of a circle. Further, as indicated in FIG. 6, the magnetic pole surface of still another type of permanent magnet may have a depression 60 whose cross section is made elliptic and which may also be provided at the center with a vertically elongate hole 61 penetrating the underlying permanent magnet.

The magnetizing device of a magnetron which comprises a pair of permanent magnets whose magnetic pole surface is depressed with a inner surface formed like any of the shapes of FIGS. 4, 5 and 6 enables a magnetic field to be created with a uniform distribution in an interaction space defined between the mutually facing magnetic pole surfaces of the paired permanent magnets, thereby attaining the same effect as the preceding embodiment.

Figure 7:
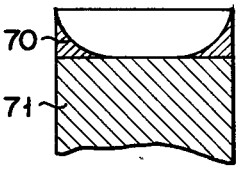
FIGS. 7 to 12 and 14, 15 are fractional sectional views of magnetizing devices according to still other embodiments of the invention.
Figure 8:
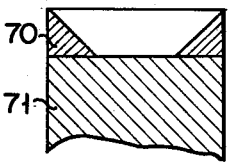
Figure 9:
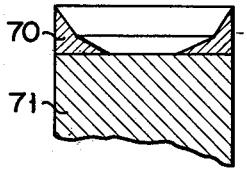
Figure 10:
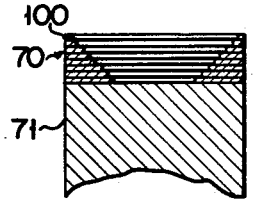
Figure 11:
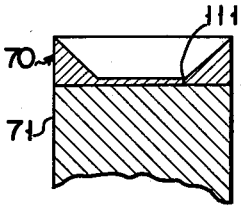
Figure 12:
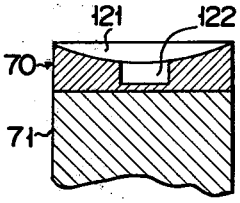

With the embodiments of FIGS. 4, 5 and 6, the magnetizing device comprises a pair of permanent magnets, having the magnetic pole surfaces machined alike in different ways. As illustrated in FIGS. 7 to 12, however, a separate magnetic member 70 made of, for example, iron and machined as illustrated may be mounted on each of the mutually facing flat magnetic pole surfaces of a pair of round cylindrical permanent magnets. In FIG. 7, the inner peripheral wall of an annular magnetic member 70 is machined to present a tapered curved surface (constituting part of the peripheral surface of a revolving ellipsis). Also in FIG. 8, the inner peripheral wall of an annular magnetic member 70 is so depressed as to present a cross section shaped in a tapered form whose inclined planes are made flat. In FIG. 9, the inner peripheral wall of an annular magnetic member 70 is machined to present a double-tapered cross section, whose inclined planes are also made flat. The magnetic member 70 of FIG. 10 is formed of a plurality of superposed thin disc-like magnetic units 100 bored at the center with a circular hole. A vertically elongate cavity penetrating the laminate has its diameter progressively decreased toward the flat magnetic pole surface of the underlying permanent magnet 71. Therefore, the inner peripheral wall of the magnetic member 70 as a whole presents a stepped form. In FIG. 11, a magnetic member 70 shaped like that of FIG. 8 is mounted on the flat magnetic pole surface of the permanent magnet 71. That portion 111 of the bottom of the magnetic member 70 which faces the central portion of the magnetic pole surface of the underlying permanent magnet 71 is made thin. In FIG. 12, a magnetic member 70 fitted to the flat magnetic pole surface of the underlying permanent magnet 71 is provided with a depression 121 whose surface indicates the form of a revolving ellipsis and a recess 122 formed below the center of the bottom wall of said depression 121. That portion of the bottom wall of the recess 122 which faces the central portion of the magnetic pole surface of the underlying permanent magnet 71 is made thin.

Machining of the magnetic member 70 into various forms illustrated in FIGS. 7 to 12 can be effected far more easily that that of the magnetic pole surface of, for example, a rare earth permanent magnet 71 itself. In the embodiments of FIGS. 7 to 12, the magnetic pole surface of the permanent magnet 71 is covered with the magnetic member 70 not wholly, but only partially (FIGS. 7 to 10), or that portion 111 of the bottom wall of the magnetic member 70 which faces the central portion of the magnetic pole surface of the permanent magnet 71 is made thin (FIGS. 11 and 12). Therefore, the permanent magnet 71 is little restricted in applying a magnetic force to an interaction space formed between the cathode 14 and anode 13.

Figure 13:
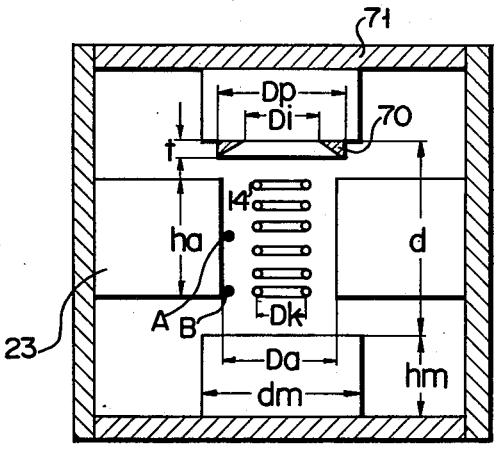
FIG. 13 gives the concrete numerical data associated with the magnetizing device of the invention.

There will now be described by reference to FIG. 13 with concrete numerical values an example of a magnetic device, the magnetic member 70 of which is fitted, after properly machined, to the mutually facing magnetic pole surfaces of the above-mentioned permanent magnets (FIGS. 7 to 12). Referring to FIG. 13, the diameter of the permanent magnet 71 is denoted by D*m*, the height by *hm*, the outer diameter of the magnetic member 70 by D*p*, the inner diameter of the magnetic member 70 by D*i*, the thickness by *t*, the distance between the mutually facing magnetic pole surfaces of the paired permanent magnets 21, 22 by *d* the diameter of the cathode 14 by D*k*, the diameter of the interaction space defined by the vanes 23 in a direction perpendicular to the axis of the magnetizing device by D*a*, and the height of each vane 23 by *ha*.

Now let the following data be assumed:

Minimum magnetic flux density in the interaction space

= 1500 Gauss units $d$ = 19 mm $ha$ = 9 mm

D$a$ = 10.5 $\phi$mm

D$k$ = 5.3 $\phi$mm

Frequency of oscillation $f$ = 2450 MHz

Then, the concrete numerical values of the other items associated with the magnetic device vary with the material of a permanent magnet, as shown in Table 1 below.

Table 1

| Material of Permanent magnet | Dm | hm | Dp | Di | t |
|---|---|---|---|---|---|
| Samarium cobalt ($SmCo_5$) | 20$\phi$ | 5 | 18$\phi$ | 7$\phi$ | 2 |

Table 1-continued

| Material of Permanent magnet | Dm | hm | Dp | Di | t |
|---|---|---|---|---|---|
| Cerium cobalt ($CeCO_5$) | 20ϕ | 8 | 18ϕ | 7ϕ | 2 |

Note: The above values are in units of mm.

In the above-mentioned case, the interaction space provided by the magnetic device has a magnetic flux density ranging approximately from 1500 to 1700 Gauss units. Point A in FIG. 13 represents a minimum magnetic flux density, and point B a maximum magnetic flux density.

Figure 14:
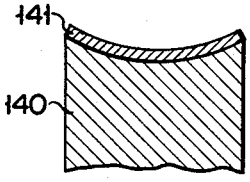

Further, it is possible, as shown in FIG. 14, to provide the magnetic pole surface of a permanent magnet 140 with a depression whose surface has the form of a revolving ellipsis and also with a pole piece 141 of uniform thickness which is designed uniformly to distribute a magnetic field created by the permanent magnet 140 in the interaction space formed between the cathode 14 and anode 13 and is shaped in a form conforming to the cross section of the depression of the magnetic pole surface of the permanent magnet 140.

Figure 15:
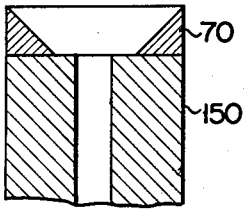

As illustrated in FIG. 15, a magnetic member 70 of FIG. 8 may be mounted on the flat magnetic pole surface of a cylindrical permanent magnet 150, with the center of the depression of said magnetic member 70 bored with a vertically elongate hole penetrating the underlying permanent magnet 150.

Figure 16:
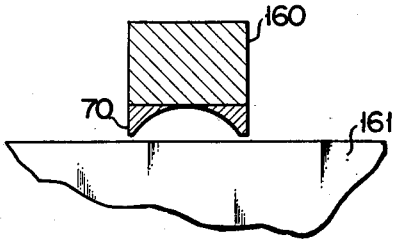
FIG. 16 is a sectional view of a magnetizing device according to a further embodiment of the invention used with a magnetron provided with external permanent magnets.
Figure 17:
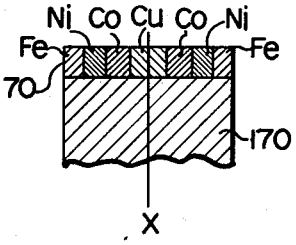
FIG. 17 is a fractional cross sectional view of a magnetizing device according to a still further embodiment of the invention.

The foregoing description refers to the embodiments in which the magnetron had a pair of permanent magnets sealed in a vacuum bulb. However, this invention is also applicable to a magnetizing device shown in FIG. 16 which is constructed by fitting a magnetic member 70 to the flat magnetic pole surface of a permanent magnet 160 with a small gap allowed between the magnetic member 70 and the surface of the vacuum bulb 161 of the magnetron, and introducing cooling air into said gap to cool the permanent magnet 160, thereby providing an external permanent magnet type magnetizing device. Further, magnetizing device shown in FIG. 17 it is possible to cause the magnetic member 70 to have a flat surface so as to progressively decrease the magnetic permeability of said magnetic member 70 toward the center thereof and fit this magnetic member 70 to the magnetic pole surface of the permanent magnet. In this case, the annular elements respectively made of, for example, copper, cobalt, nickel and iron which jointly constitute the magnetic member 70 mounted on the permanent magnet 170 are arranged, as shown in FIG. 17, in the order of Cu, Co, Ni and Fe as counted from the magnetic pole center X in which these materials present a progressively smaller magnetic permeability as they approach said center X.

Even this arrangement attains the uniform distribution of a magnetic field in an interaction space formed between the mutually facing magnetic pole surfaces of a pair of permanent magnets.

The foregoing description refers to the embodiments in which a magnetron used was of a vane type. However, this invention is applicable to a magnetron of, for example, the rising sun type or hole-and-slot type.

This invention is not limited to the embodiments descirbed in the specification and shown in the appended drawings, but may be practiced with various applications and modifications within the scope of the claims in accordance with the object and spirit of the invention.

What is claimed is:

1. A magnetron device for generating a substantially uniform magnetic field which comprises a cathode electrode and an anode electrode disposed concentrically with said cathode electrode so as to jointly constitute a cylindrical electrode assembly; a plurality of vanes inwardly projected from the inner surface of said anode electrode; a resonance cavity circuit defined by a portion of said anode and vanes and for oscillating electric waves when supplied with the energy of electrons emitted from the cathode electrode; an output circuit for drawing out an oscillated output from said resonance cavity circuit; and a magnetizing device in which a pair of permanent magnets are disposed on the opposite sides of an interaction space formed between the cathode and anode, at least one of the mutually facing magnetic pole surfaces of said permanent magnets being formed into a concave shape, thereby controlling the orbit through which electrons emitted from the cathode electrode revolve about the axis of said cathode electrode.

2. The magnetron according to claim 1, wherein the magnetizing device is formed of a pair of mutually facing cylindrical permanent magnets prepared from rare earth; and the magnetic pole surface of each of said permanent magnets is provided with a depression whose surface takes the form of a revolving ellipse.

3. The magnetron according to claim 2, wherein the mutually facing magnetic pole surfaces of the paired permanent magnets are each provided with a depression whose surface is shaped like a frust conical.

4. The magnetron according to claim 2, wherein the mutually facing magnetic pole surfaces of the paired permanent magnets are each provided with a depression whose cross section is shaped like a segment of a circle.

5. The magnetron according to claim 2, wherein the mutually facing magnetic pole surfaces of the paired permanent magnets are each provided with a depression whose surface is shaped in the form of a revolving ellipsis; and the center of said depression is bored with a vertically elongate hole penetrating the underlying permanent magnet.

6. A magnetron device for generating a substantially uniform magnetic field which comprises a cathode electrode and an anode electrode disposed concentrically with said cathode electrode so as to jointly constitute a cylindrical electrode assembly; a plurality of vanes inwardly projected from the inner surface of said anode electrode; a resonance cavity circuit defined by a portion of said anode and vanes and for oscillating electric waves when supplied with the energy of electrons emitted from the cathode electrode; an output circuit for drawing out an oscillated output from said resonance cavity circuit; and a magnetizing device wherein the mutually facing surfaces of a paired permanent magnets disposed on the opposite sides of the interaction space formed between the cathode and anode are all or partially covered with a soft magnetic member, thereby controlling the orbit through which electrons emitted from the cathode electrode revolve about the axis of said cathode electrode, and at least one of the mutually facing magnetic pole surfaces of said paired permanent magnets is fitted with an annular magnetic member, the inner peripheral wall of which has its inner surface shaped concave.

7. The magnetron according to claim 6, wherein the magnetizing device is formed of a pair of mutually facing cylindrical permanent magnets prepared from rare earth.

8. The magnetron according to claim 7, wherein the inner peripheral wall of the annular magnetic member has its cross section shaped in a tapered form whose inclined planes are made flat.

9. The magnetron according to claim 7, wherein the inner peripheral wall of the annular magnetic member has its cross section shaped in a double tapered form, whose inclined planes are made flat.

10. The magnetron according to claim 7, wherein the magnetic member takes an annular shape by being formed of a plurality of laminated thin magnetic discs bored at the center with circular holes, whose diameters progressively decrease toward the magnetic pole surface of the underlying permanent magnet.

11. The magnetron according to claim 7, wherein the magnetic member has its inner peripheral wall so shaped as to present a tapered cross section, the inclined planes of which are made flat; and that portion of the bottom wall of the magnetic member which faces the center of the magnetic pole surface of the underlying permanent magnet is made thin.

12. The magnetron according to claim 7, wherein the magnetic member comprises a depression whose inner surface is shaped in the form of a revolving ellipse and a recess provided below the center of said depression; and that portion of the bottom wall of the magnetic member which faces the center of the magnetic pole surface of the underlying permanent magnet is made thin.

13. The magnetron according to claim 1, wherein the magnetic device comprises a pair of permanent magnets, whose mutually facing magnetic pole surfaces are each provided with a depression whose inner surface is shaped in the form of a revolving ellipse, and a pair of pole pieces of uniform thickness each fitted to said magnetic pole surface with a shape conforming to that of the depression of said magnetic pole surface.

14. The magnetron according to claim 1, wherein the magnetizing device comprises a pair of round cylindrical permanent magnets and a pair of annular magnetic members mounted on the mutually facing magnetic pole surfaces of the paired permanent magnets, the inner peripheral wall of each of said magnetic members being so shaped as to present a tapered cross section, whose inclined planes are made flat.

15. A magnetron device for generating a substantially uniform magnetic field which comprises a cathode electrode and an anode electrode disposed concentrically with said cathode electrode so as to jointly constitute a cylindrical electrode assembly; a plurality of vanes inwardly projected from the inner surface of said anode electrode; a resonance cavity circuit defined by a portion of said anode and vanes and for oscillating electric waves when supplied with the energy of electrons emitted from the cathode electrode; an output circuit for drawing out an oscillated output from said resonance cavity circuit; and a magnetizing device wherein the mutually facing surfaces of a paired permanent magnets disposed on the opposite sides of the interaction space formed between the cathode and anode are covered with materials which present a progressively smaller magnetic permeability as they approach the center of the magnetic pole surface, thereby controlling the orbit through which electrons emitted from the cathode electrode revolve about the axis of said cathode electrode.

* * * * *